US009642478B1

(12) United States Patent
Tanger et al.

(10) Patent No.: US 9,642,478 B1
(45) Date of Patent: May 9, 2017

(54) EXPANDABLE MOUNTING APPARATUS FOR SUSPENDING OBJECTS ON A WALL

(71) Applicants: Jonathan P Tanger, Plantation, FL (US); Davina C Lochan, Plantation, FL (US)

(72) Inventors: Jonathan P Tanger, Plantation, FL (US); Davina C Lochan, Plantation, FL (US)

( * ) Notice: Subject to any disclaimer, the term of this patent is extended or adjusted under 35 U.S.C. 154(b) by 0 days.

(21) Appl. No.: 15/042,043

(22) Filed: Feb. 11, 2016

(51) Int. Cl.
*A47G 1/24* (2006.01)
*A47G 1/16* (2006.01)

(52) U.S. Cl.
CPC ..... *A47G 1/16* (2013.01)

(58) Field of Classification Search
CPC ..... A47G 1/16
USPC .... 248/257, 259, 260, 265, 298.1, 317, 324, 248/326, 480, 493, 476, 496
See application file for complete search history.

(56) References Cited

U.S. PATENT DOCUMENTS 745,426 A * 12/1903 Ebert ..... A47H 1/13 248/260
951,700 A * 3/1910 Robert ..... A47H 1/13 248/260
1,033,747 A * 7/1912 Smyth ..... A47H 1/13 248/258
1,107,686 A * 8/1914 Mehrmann ..... A47G 1/16 248/495
3,838,842 A * 10/1974 McCracken ..... A47G 1/1613 248/476
4,753,410 A * 6/1988 Dyer ..... B60R 1/078 248/298.1
6,391,399 B1 * 5/2002 Woltmann ..... A41G 1/00 248/27.8
9,279,538 B1 * 3/2016 Wening ..... F16M 13/022
2015/0300559 A1 * 10/2015 Callif ..... F16B 5/0225 248/287.1

* cited by examiner

*Primary Examiner* — Gwendolyn Baxter
(74) *Attorney, Agent, or Firm* — Gulf Coast Intellectual Property Group

(57) ABSTRACT

A mounting apparatus that is configured to provide alternate lengths in order to assist in mounting an object or a plurality of objects to a wall. The mounting apparatus includes a first portion and a second portion that are slidably engaged. The first portion and second portion are rectangular in shape an planar in manner. The first portion includes an upper edge that is configured to mateably engage with the upper edge of the second portion and further maintain engagement therewith as the second portion is slidably moved with respect to said first portion. The second portion includes a rear surface that has a ledge member integrally formed therewith. The ledge member includes an upper surface that is perpendicular to the rear surface of the second portion. A plurality of clips are provided and are configured to be secured to a decorative element and releasably engaged with the mounting apparatus.

17 Claims, 3 Drawing Sheets

EXPANDABLE MOUNTING APPARATUS FOR SUSPENDING OBJECTS ON A WALL

FIELD OF THE INVENTION

The present invention relates generally to devices operable to hang an object on a wall, more specifically but not by way of limitation an apparatus configured be mounted to a wall and have objects releasably secured thereto wherein the apparatus includes a first portion and a second portion that are slidably coupled so as to provide a mounting apparatus that is configurable in length.

BACKGROUND

Millions of homeowners regularly decorate the interior of the rooms of their homes. Interior design is known to include numerous elements and some exemplary decorative elements are paintings and pictures. As is known in the art the aforementioned type of decorative elements are typically suspended on a wall utilizing various types of fasteners. These fasteners range from standard hook-type fasteners to other more elaborate mounts. It is very common whether in residential or commercial environments to hang the aforementioned decorative elements in groups. Whether it is a group of pictures or a single piece of art that is separated on two or more substrates, the hanging of groups of decorative elements can be challenging.

One problem with conventional fasteners is that they do not facilitate the alignment of one decorative element with another. By way of example but not limitation, if a user hangs a picture on a wall and desires to hang another picture adjacent thereto, the user must utilize a tool such as but not limited to a level to ensure alignment between the two pictures. This can be cumbersome and difficult to achieve depending upon the decorative element that is being suspended on a wall. Additionally, some decorative elements are formed having multiple dimensions, i.e., a single piece may consist of a first portion and a second portion that are angular with respect to each other and the suspending of these types of decorative elements along a wall can not be accomplished with a conventional fastener.

Accordingly, there is a need for a mounting apparatus that is operable to be secured to a wall wherein the mounting apparatus is configured to have the length thereof adjustable so as to facilitate the releasable securing of more than one decorative element thereto.

SUMMARY OF THE INVENTION

It is the object of the present invention to provide a mounting apparatus that is operable to suspend an object adjacent to a wall wherein the mounting apparatus includes a first portion and a second portion.

Another object of the present invention is to provide a mounting apparatus that is secured to a wall and configured to have at least one object releasably secured thereto wherein the first portion and second portion are slidably coupled.

A further object of the present invention is to provide a mounting apparatus that is configured to be secured to a wall utilizing fasteners such as but not limited to screws wherein the first portion has a body that is planar in manner having an upper edge that is shaped so as to maintain engagement with the upper edge of the body of the second portion.

An additional object of the present invention is to provide a mounting apparatus that is operable to be secured to a wall and releasably receive at least one decorative element thereon wherein the body of the first portion includes a lower edge that is formed so as to maintain engagement with the lower edge of the body of the second portion.

Still another object of the present invention is to provide a mounting apparatus that includes a first portion and a second portion configured to be slidably coupled wherein the body of the second portion includes a rear ledge member formed in the rear surface of the body of the second portion.

Yet another object of the present invention is to provide a mounting apparatus that is configured to be expandable in length so as to facilitate the hanging of more than one decorative element thereon wherein the mounting apparatus utilizes a plurality of mounting clips to facilitate the releasable securing of a decorative element to the mounting apparatus.

An additional object of the present invention is to provide mounting apparatus that includes a first portion and second portion slidably coupled so as to provide alternate lengths of the mounting apparatus that further includes at least one support member being adjacent to the first portion and intermediate the first portion and the wall to which the mounting apparatus has been secured.

An added object of the present invention is to provide a mounting apparatus that is configured to be alterable in length so as to facilitate the suspending of more than one decorative element thereon wherein the first portion and second portion include a plurality of apertures formed therein.

An additional object of the present invention is to provide a mounting apparatus that includes a first portion and second portion that are slidably coupled that is manufactured from a suitable durable material such as but not limited to aluminum.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
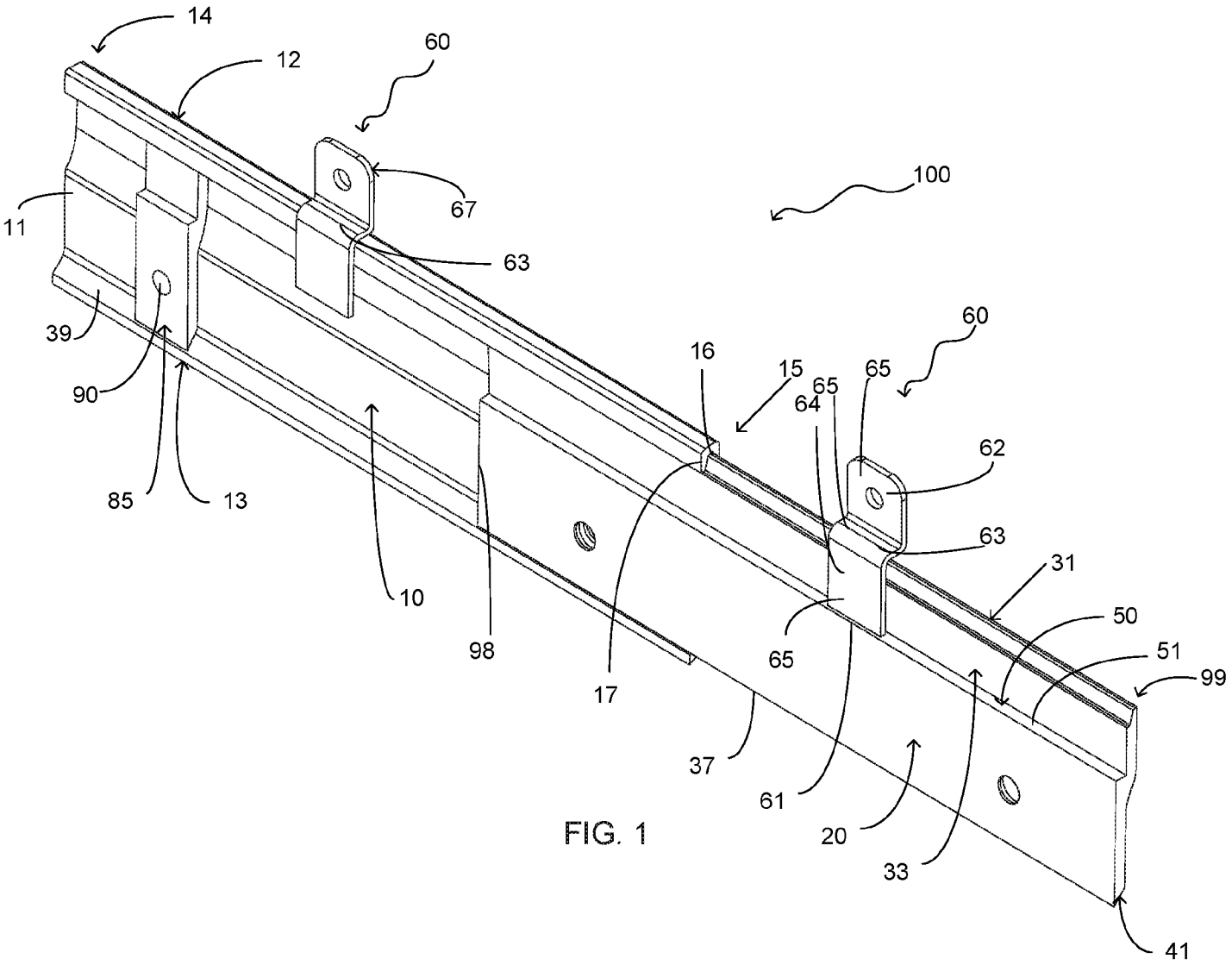
FIG. 1 is a rear perspective view of the present invention with the second portion extended outward from the first portion.

Referring now to the drawings submitted herewith, wherein various elements depicted therein are not necessarily drawn to scale and wherein through the views and figures like elements are referenced with identical reference numerals, there is illustrated mounting apparatus 100 constructed according to the principles of the present invention.

Figure 2:
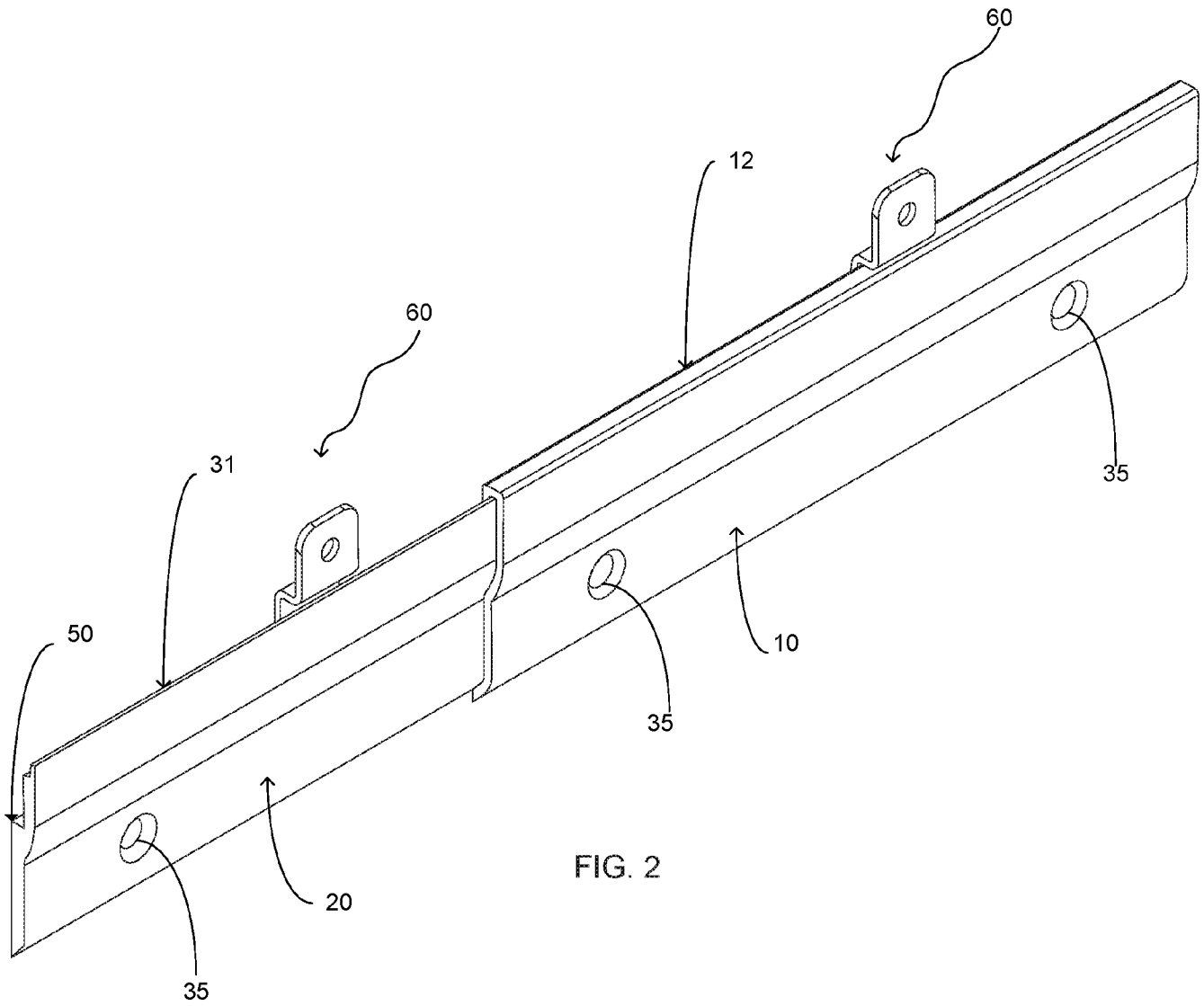
FIG. 2 is a front perspective view of the present invention with the second portion extended outward from the first portion.

Referring particular to FIGS. 1 and 2 herein, the mounting apparatus 100 includes a first portion 10 and a second portion 20. The first portion 10 and second portion 20 are manufactured from a suitable durable material such as but not limited to aluminum. The first portion 10 and second portion 20 are configured to be slidable coupled as further discussed herein so as to provide varying lengths of the mounting apparatus 100. The first portion 10 includes body 11 that is generally planar in manner having an upper edge 12 and lower edge 13. The first portion 10 is generally rectangular in shape and includes a first end 14 and second end 15. The upper edge 12 of the first portion 10 is shaped to receive the upper edge 31 of the second portion 20 and allow slidable engagement therewith and further provide securing of the second portion 20 to the first portion 10. The upper edge 12 includes member 16 that extends outward from the body 11 and is intermediate the first end 14 and second end 15. Member 16 is perpendicular to the body 11. Integrally formed with member 16 distal to the body 11 is leg 17. Leg 17 extends downward from member 16 and functions to engage at least a portion of the rear surface 33 proximate upper edge 31 of the second portion 20 so as to ensure the maintaining of captive engagement intermediate the first portion 10 and second portion 20 yet still allowing the slidable movement therebetween. While a specific design for the upper edge 12 of the first portion 10 has been illustrated and discussed herein, it is contemplated within the scope of the present invention that the upper edge 12 of the first portion 10 could be formed in alternate manners and still achieve the desired functionality as described herein.

The lower edge 13 of the first portion 10 is configured so as to slidably engage with the lower edge 37 of the second portion 20. Lower edge 13 includes an angular section 39 that is operable to mateably engage with the angular leading edge 41 of the lower edge 37 of the second portion 20. It is contemplated within the scope of the present invention that numerous configurations of the lower edge 37 and lower edge 13 could provide the desired functionality as described herein.

The first portion 10 and second portion 20 include apertures 35 that are formed therein utilizing suitable techniques. The apertures 35 are spaced such that they are equidistant with respect to each other. It is contemplated within the scope of the present invention that the first portion 10 and second portion 20 could have varying amounts of apertures 35 formed therein depending on factors such as but not limited to the length of the first portion 10 and second portion 20 and the weight in which it is desired for the mounting apparatus 100 to support. The apertures 35 are further contemplated to be provided in various diameters so as to accommodate fasteners therethrough having different sizes.

Formed in the rear surface 33 of the second portion 20 is ledge member 50. Ledge member 50 extends the length of the second portion 20 intermediate first end 98 and second end 99. The ledge member 50 includes an upper surface 51 that is perpendicular to the rear surface 33 of the second portion. Ledge member 50 functions to ensure that a decorative element being releasably secured to the mounting apparatus 100 will be hung in a level orientation. The upper surface 51 of ledge member 50 is configured to engage the lower edge 61 of mounting clip 60. Mounting clips 60 are configured with a first section 62, second section 63 and third section 64. The sections 65 are formed such that each section 65 is perpendicular to the adjacent section. When the second portion 20 is extended outward from the first portion 10 as shown herein in FIG. 1 so as to accommodate either a large or a second decorative element, the mounting clips 60 subsequent being secured to the decorative element are engaged with the mounting apparatus 100. The third section 64 of the mounting clips 60 are placed such that the third section is intermediate a wall to which the mounting apparatus 100 is secured and the first portion 10 and second portion 20. In the specific configuration illustrated herein in FIG. 1, the lower edge 61 engages the upper surface 51 of the ledge member 50 whereas the second section 63 of the second mounting clip 67 engages the upper edge 12 of the first portion 10. The ledge member 50 is positioned to ensure that the mounting clips 60 are level in orientation with respect to each other. This facilitates a level hanging of either a large decorative element or a plurality of decorative elements wherein the decorative elements are being releasably secured to both the first portion 10 and second portion 20 utilizing separate mounting clips 60. It should be recognized by those skilled in the art that the positioning of the ledge member 50 is dependent on the size of the mounting clip 60 specifically the length of the third section 64. It is contemplated within the scope of the present invention that varying sizes of mounting clips 60 configured with alternate positions of the ledge member 50 could be utilized in order to achieve the desired functionality as described herein.

Figure 3:
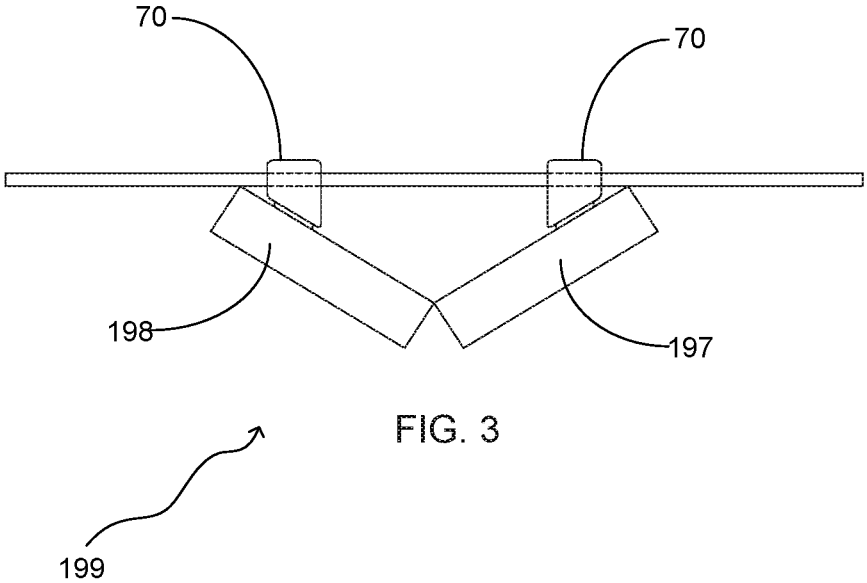
FIG. 3 is a top view of the present invention having angular mounting clips secured thereto so as to suspend an exemplary decorative element that has two segments wherein the two segments are angular with respect to each other.
Figure 4:
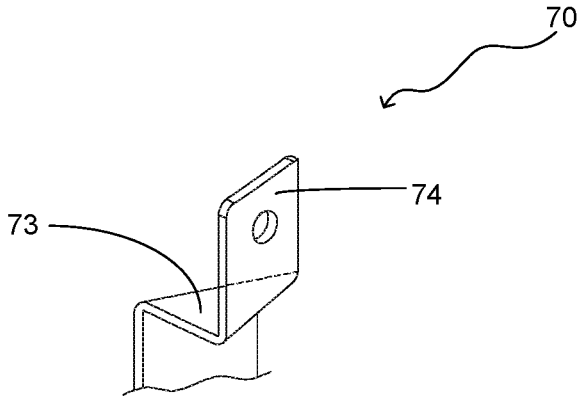
FIG. 4 is a detailed view of an angled mounting clip of the present invention.

Shown in particular in FIG. 3 and FIG. 4 is an alternative embodiment of the mounting clips 70. As previously mentioned herein, the mounting apparatus 100 could be extended in length to accommodate a larger exemplary decorative element 199 as shown in particular in FIG. 3 having a first section 198 and a second section 197. If the exemplary decorative element 199 was desired to be suspended on a wall such that the first section 198 and second section 197 were positioned in an angular manner with respect to each other, the mounting clips 70 could be utilized. Mounting clip 70 is constructed similarly to mounting clip 60 except that the middle section 73 is triangular in shape so as to position the first section 74 in an angular manner and provide the functionality as described herein. It is contemplated within the scope of the present invention that numerous embodiments of the mounting clips 60 could be construed in order to achieve a hanging of a particular decorative element.

Illustrated herein in FIG. 1 is a support member 85. Support member 85 is operable to be adjacent to the rear surface 7 of body 11 of the first portion 10. The support member 85 is formed in a shape so as to have the same profile shape as the second portion 20. The support member 85 includes an aperture 90 bored therethrough and the support member 85 is operable to be positioned such that aperture 90 and aperture 35 are in alignment so as to receive a fastener therethrough. The support member 85 functions to prevent compression of the first portion 10 when the mounting apparatus 100 is in a position such as that illustrated in FIGS. 1 and 2 wherein a section of the first portion 10 does not have the second portion 20 adjacent thereto. In this position this section of the first portion 10 could be compressed or bind as a result of too much force from a fastener that has been journaled through aperture 35 when securing the mounting apparatus to a wall. The support member 85 is operable to prevent binding and/or compression of the first portion 10 so as to ensure the second portion 20 can maintain slidable engagement therewith. While a specific shape of the support member 85 has been illustrated and discussed herein, it is contemplated within the scope of the present invention that the support member 85 could be formed in various different sizes and shapes.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A mounting apparatus configured to be secured to a wall wherein the mounting apparatus is operable to have at least one decorative element secured thereto comprising:

a first portion, said first portion having a body, said body of said first portion being planar in manner, said body of said first portion having an upper edge and a lower edge, said body of said first portion having a first end and a second end, said first portion having a front surface and a rear surface;

a second portion, said second portion having a body, said second portion having an upper edge and a lower edge, said second portion having a first end and a second end, said upper edge of said second portion configured to mateably engage with said upper edge of said first portion, said second portion having a front surface and a rear surface;

a ledge member, said ledge member being formed in said rear surface of said second portion, said ledge member extending intermediate said first end and said second end of said second portion, wherein said ledge member further includes an upper surface, said upper surface being perpendicular to said rear surface of said second portion; and wherein said second portion of the mounting apparatus is slidably engaged with the first portion of the mounting apparatus so as to provide varying lengths of the mounting apparatus.

2. The mounting apparatus as recited in claim 1, and further including a plurality of apertures, said plurality of apertures being present in said first portion and said second portion.

3. The mounting apparatus as recited in claim 2, wherein said lower edge of said second portion is configured to mateably engage the lower edge of said first portion.

4. The mounting apparatus as recited in claim 3, and further including at least one clip, said at least one clip configured to be secured to a decorative element, said at least one clip configured to be releasably secured to the mounting apparatus subsequent securing to the decorative element so as to suspend the decorative element on a wall.

5. The mounting apparatus as recited in claim 4, and further including at least one support member, said at least one support member positioned behind said first portion subsequent said second portion being moved to a position such that said second portion is extending outward from said first portion.

6. A mounting apparatus configured to be secured to a wall wherein the mounting apparatus is operable to have at least one decorative element secured thereto comprising:

a first portion, said first portion having a body, said body of said first portion being planar in manner, said body of said first portion having an upper edge and a lower edge, said upper edge further including a member being perpendicular thereto and extending outward therefrom, said member further including a leg member extending downward therefrom, said leg member being integrally formed with said member distal to said body of said first portion, said body of said first portion having a first end and a second end, said first portion having a front surface and a rear surface;

a second portion, said second portion having a body, said body of said second portion being planar in manner, said second portion having an upper edge and a lower edge, said second portion having a first end and a second end, said upper edge of said second portion configured to mateably engage with said member and said leg member of said upper edge of said first portion, said second portion having a front surface and a rear surface;

a plurality of clips, said plurality of clips operable to releasably secure the at least one decorative element to the mounting apparatus, said plurality of clips configured to be secured to the decorative element and subsequently releasably secured to the mounting apparatus;

a ledge member, said ledge member being integrally formed in the rear surface of the body of said second portion; and wherein said second portion of the mounting apparatus is slidably engaged with the first portion of the mounting apparatus so as to configure the mounting apparatus is alternate lengths prior to securing to the wall.

7. The mounting apparatus as recited in claim 6, wherein said ledge member further includes an upper surface, said upper surface being perpendicular to said rear surface of said second portion, said upper surface positioned so as to engage a portion of said plurality of clips coupled to said second portion.

8. The mounting apparatus as recited in claim 7, and further including a support member, said support member configured to mateably engage the rear surface of said body of said first portion subsequent said second portion being slidably removed from being adjacent thereto, said support member having a profile shape similar to said second portion.

9. The mounting apparatus as recited in claim 8, wherein said first portion and said second portion have a plurality of apertures journaled therethrough, said plurality of apertures being spaced in an equidistant manner.

10. The mounting apparatus as recited in claim 9, wherein at least two of said plurality of clips have a middle section that is triangular in shape so as to provide an upper section that is angular in orientation for mounting of the decorative element.

11. The mounting apparatus as recited in claim 10, wherein a bottom edge of at least one of said plurality of clips is configured to engage the upper surface of said ledge member formed in the second portion so as to maintain a level orientation with at least one of said plurality of clips that is engaged with said first portion of the mounting apparatus.

12. A mounting apparatus configured to be secured to a wall wherein the mounting apparatus is operable to have at least one decorative element secured thereto and wherein the mounting apparatus is configurable to have alternate lengths comprising:

a first portion, said first portion having a body, said body of said first portion being planar in manner and rectangular in shape, said body of said first portion having an upper edge and a lower edge, said upper edge further including a member being perpendicular thereto and extending outward therefrom, said member further including a leg member extending downward therefrom, said leg member being integrally formed with said member distal to said body of said first portion, said body of said first portion having a first end and a second end, said first portion having a front surface and a rear surface;

a second portion, said second portion operably coupled to said first portion, said second portion having a body, said body of said second portion being planar in manner and rectangular in shape, said second portion having an upper edge and a lower edge, said second portion having a first end and a second end, said upper edge of said second portion configured to mateably engage with said member and said leg member of said upper edge of said first portion so as to maintain engagement therewith as said second portion is slidably moved with respect to said first portion, said second portion having a front surface and a rear surface;

a plurality of clips, said plurality of clips having a first section, a second section and a third section, said plurality of clips configured to have said first section secured to the decorative element said second section being intermediate and perpendicular to said first section and said third section, said third section configured to be releasably secured to the mounting apparatus, said third section having a bottom edge, a ledge member, said ledge member being integrally formed in the rear surface of the body of said second portion, said ledge member having an upper surface, said upper surface of said ledge member positioned so as to engage the bottom edge of said third section;

wherein said second portion of the mounting apparatus is slidably engaged with the first portion of the mounting apparatus so as to configure the mounting apparatus is alternate lengths prior to securing to the wall.

13. The mounting apparatus as recited in claim 12, and further including a support member, said support member configured to mateably engage the rear surface of said body of said first portion subsequent said second portion being slidably removed from being adjacent thereto, said support member having a profile shape similar to said second portion, said support member further including an aperture.

14. The mounting apparatus as recited in claim 13, wherein said lower edge of said first portion includes an angular portion extending the length thereof, said lower edge of said second portion having an angular leading edge mateable with said angular portion of said lower edge of said first portion.

15. The mounting apparatus as recited in claim 14, wherein said first portion and said second portion include a plurality of apertures drilled therethrough, said plurality of apertures operable to receive fasteners therethrough so as to facilitate securing of the mounting apparatus to the wall.

16. The mounting apparatus as recited in claim 15, wherein at least two of said plurality of clips are configured such that said second section is triangular in shape so as to provide a first section that is angular in orientation for mounting of the decorative element.

17. The mounting apparatus as recited in claim 16, wherein the bottom edge of the third section of least one of said plurality of clips is configured to engage the upper surface of said ledge member formed in the second portion so as to maintain a level orientation with at least one of said plurality of clips that is engaged with said first portion of the mounting apparatus.

* * * * *